US006338333B1

(12) United States Patent
Brosseau et al.

(10) Patent No.: US 6,338,333 B1
(45) Date of Patent: Jan. 15, 2002

(54) INTEGRATED FUEL DELIVERY MODULE FOR DIRECT INJECTION

(75) Inventors: Michael Roland Brosseau, Rochester; Curtis David Lamb, Scottsville; Joseph George Spakowski, Rochester, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/329,508

(22) Filed: Jun. 10, 1999

(51) Int. Cl.[7] ..... F02M 37/04
(52) U.S. Cl. ..... 123/456; 123/470
(58) Field of Search ..... 123/294–305, 123/456, 470, 472

(56) References Cited

U.S. PATENT DOCUMENTS 5,097,594 A * 3/1992 Daly et al. ..... 123/456 X
5,423,303 A * 6/1995 Bennett ..... 123/456 X
6,062,200 A * 5/2000 Hofmeister ..... 123/456 X
6,148,797 A * 11/2000 Gmelin ..... 123/456

* cited by examiner

*Primary Examiner*—Tony M. Argenbright
(74) *Attorney, Agent, or Firm*—John Vanophem

(57) ABSTRACT

A fuel delivery module integrates a fuel rail, with its associated connections, features and components, with the injectors for one bank of a direct injection engine. When the module is secured to the engine, loading springs between the inlet ends of the injectors and abutments in the mounting recesses accommodate variations in manufacturing and assembly tolerances to provide adequate but not excessive loading of the injectors against associated seats of the engine. Manufacturing and assembly costs are reduced by the use a module with injectors pre-installed. Also, the module may be pretested in a suitable test fixture prior to installation to assure proper flow and spray development from each of the injectors. The module may integrate other components also, such as intake air passages, EGR passages and coolant passages and their associated components. Various examples of injector loading springs are described.

16 Claims, 9 Drawing Sheets

INTEGRATED FUEL DELIVERY MODULE FOR DIRECT INJECTION

TECHNICAL FIELD

This invention relates to direct injection (DI) of fuel into the combustion chambers of an internal combustion engine and, more particularly, to an integrated fuel delivery module for mounting a plurality of DI injectors and potentially other components on a direct injection gasoline or similar engine.

BACKGROUND OF THE INVENTION

The direct injection (DI) of fuel, such as gasoline, into an engine combustion chamber requires that a DI fuel injector for each cylinder of the engine be mounted in the engine cylinder head or other combustion chamber defining member. The tip or nozzle end of the injector is directly exposed to high combustion pressures periodically occurring in the combustion chamber, and so a positive load must be applied to the injector to hold it in place and ensure that it remains sealed against leakage of exhaust gases from the combustion chamber.

In the past, this has been accomplished by fastening a tab or clamp on the injector directly to the cylinder head or other component. However, this requires that each injector be individually mounted to the cylinder head and adds to the manual labor cost in assembly of the engine.

SUMMARY OF THE INVENTION

The present invention solves this problem by providing an integrated fuel delivery module in which all the injectors intended for mounting in one bank of a multi-cylinder engine are installed prior to assembly. Fastening means are provided for mounting the module directly to the engine cylinder head or other combustion chamber defining component. The module includes fuel passages and may include related controls and features involved in fuel delivery to the engine. Loading springs are provided to apply a load between the inlet ends of the injectors and abutments in the body of the module so that the injectors are properly seated against their respective sealing surfaces with an adequate but not excessive load.

If desired, the module may comprise a portion of an intake manifold including air intake passages, exhaust gas recirculation passages and coolant passages with suitable controls for regulating EGR flow, as well as the fuel pressure delivered to the injectors.

These and other features and advantages of the invention will be more fully understood from the following description of certain specific embodiments of the invention taken together with the accompanying drawings.

DESCRIPTION OF THE PREFERRED EMBODIMENT

Figure 1:
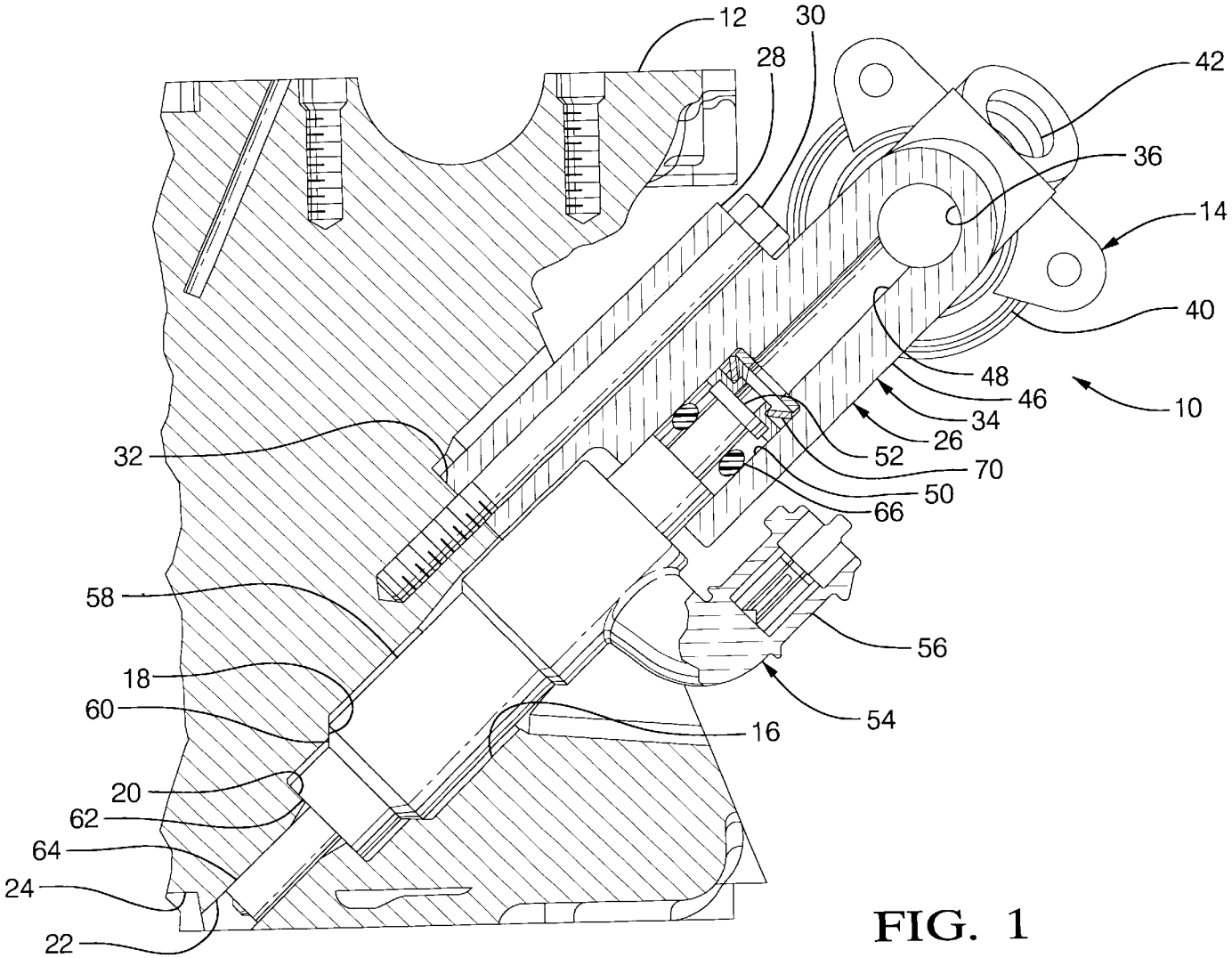
FIG. 1 is a fragmentary cross-sectional view through a portion of an engine assembly mounting an integrated fuel delivery module according to the invention.

Referring first to FIG. 1 of the drawings in detail, numeral 10 generally indicates a portion of an engine assembly for a direct injection internal combustion gasoline engine. Assembly 10 includes a cylinder head 12 to which is directly mounted a first embodiment of integrated fuel delivery module 14, also illustrated in FIG. 2.

As seen in FIG. 1, the cylinder head 12 includes a generally cylindrical injector mounting recess 16 for each cylinder of the engine. Recess 16 is stepped down to provide axially spaced alternate seats 18, 20 and terminates in a smaller bore 22 that opens directly to the engine combustion chamber 24.

Figure 2:
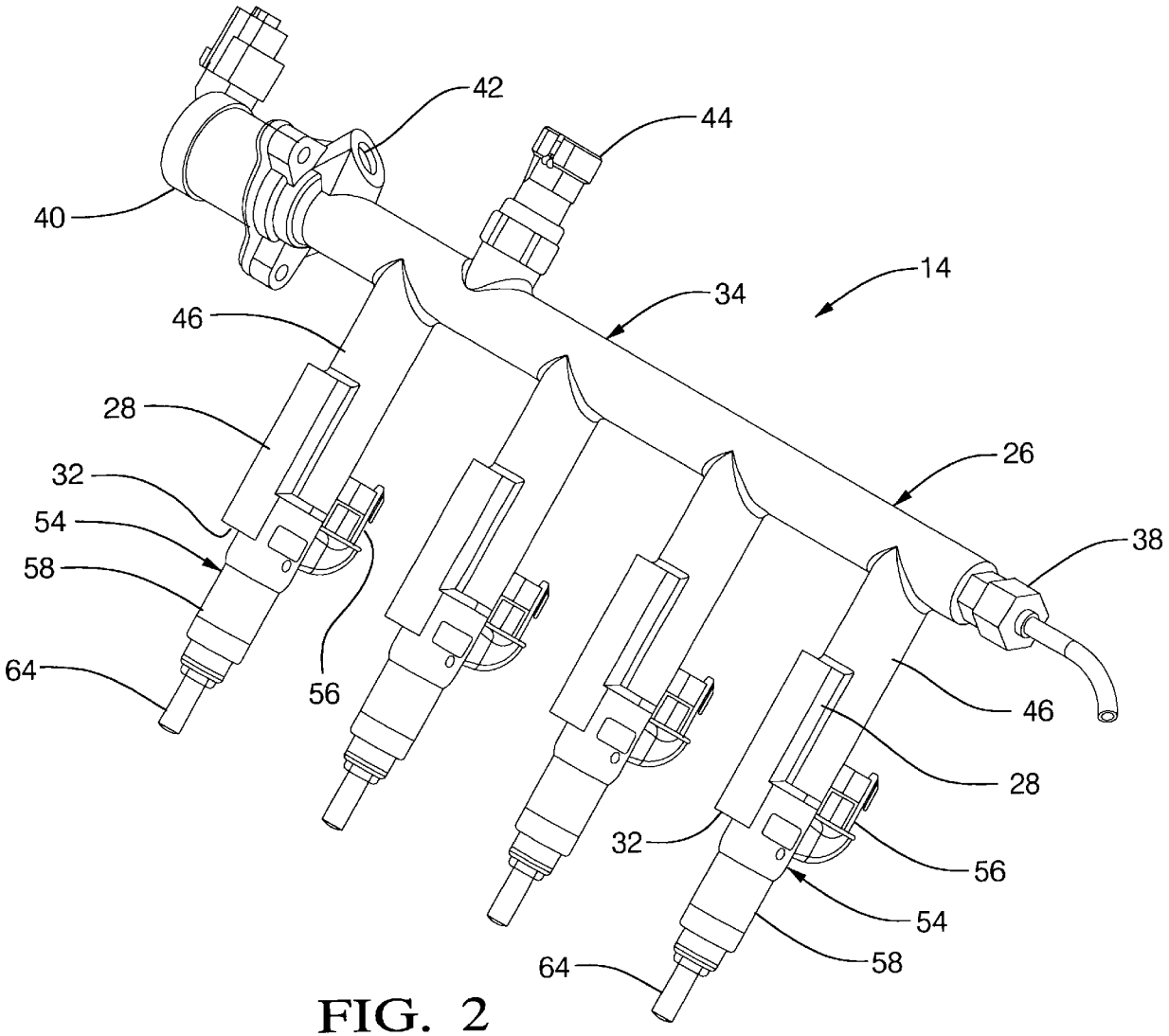
FIG. 2 is a pictorial view of the module of FIG. 1.

The fuel delivery module 14, shown in FIGS. 1 and 2, includes a body 26 having fastener bosses 28 receiving screws 30 for securing the module against mounting surfaces 32 of the cylinder head. Module 14 further includes a fuel rail 34 having a common fuel inlet passage 36 extending longitudinally in the body. A fuel inlet fitting 38 is mounted at one end of passage 36 and a fuel pressure regulator 40 is mounted at the other end. A fuel return fitting 42 is also provided adjacent the pressure regulator end of the fuel rail and a fuel pressure sensor 44 connects with the inlet passage 36 intermediate its ends. At equally spaced locations along the length of the fuel rail, there are laterally extending tubular portions 46 on which the previously mentioned mounting bosses 28 are located. The tubular portions 46 define laterally extending feeder passages 48 connecting the common inlet passage 36 with mounting recesses 50.

In each of the recesses 50, the inlet end 52 of a DI fuel injector 54 is received. Each injector 54 also includes an electrical connector 56 which extends outside the cylinder head for access, and a generally cylindrical lower end 58, that is received in the cylinder head recess 16 of an associated cylinder. Each injector includes a sealing surface 60 or 62 which engages one of the seats 18, 20 upon installation in its cylinder head recess 16 to prevent leakage of gas from the engine combustion chamber. A nozzle end 64 of each injector extends into its respective bore 22 for spraying fuel into the associated engine combustion chamber 24. At the inlet end 52 of each injector, an O-ring or other suitable seal 66 is provided to prevent leakage of fuel from the mounting recess in which the injector inlet is received.

Figure 3:
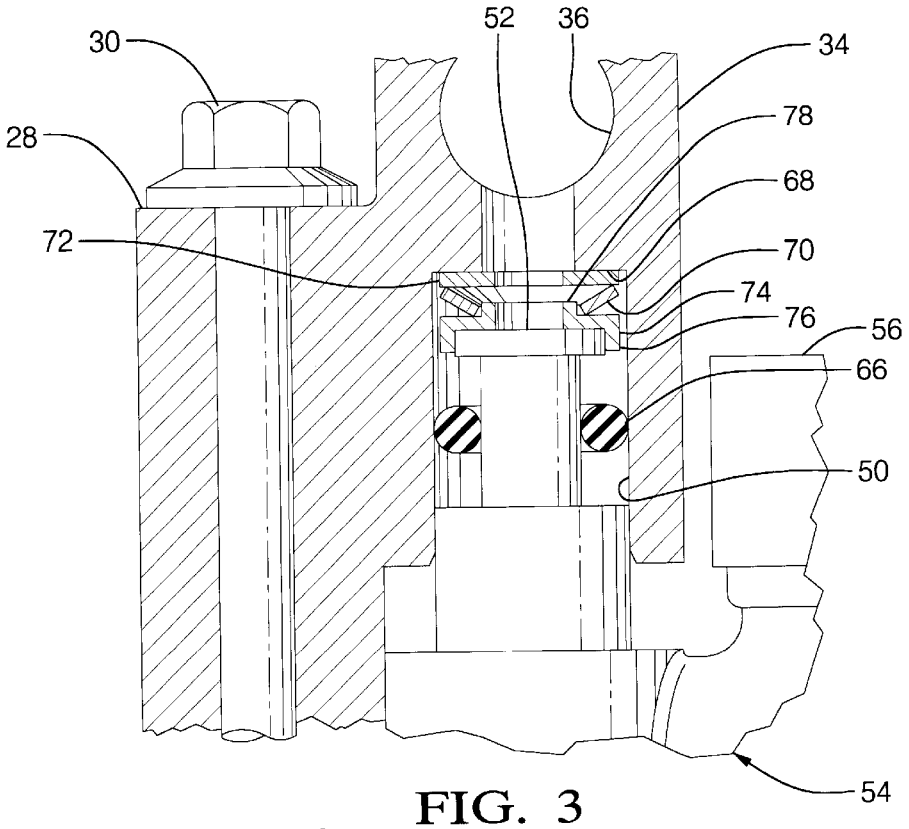
FIG. 3 is an enlarged cross-sectional view illustrating a first embodiment of loading spring for the module of FIGS. 1 and 2.

For loading the injectors with an adequate force against the seat 18 or 20, some form of spring loading is required between the inlet end 52 of each injector and an annular abutment 68 at the inner end of the mounting recess 50. In the embodiment shown in FIGS. 1 and 3, these springs take the form of a disk or Belleville type spring 70 that engages a hardened washer 72 seated against the abutment 68. Spring 70 also engages a second guided washer 74 having a peripheral outer flange 76 for centering the washer on the inlet end of the injector and an upstanding inner flange 78 which centers the disk spring 70 on the washer 74.

Figure 4:
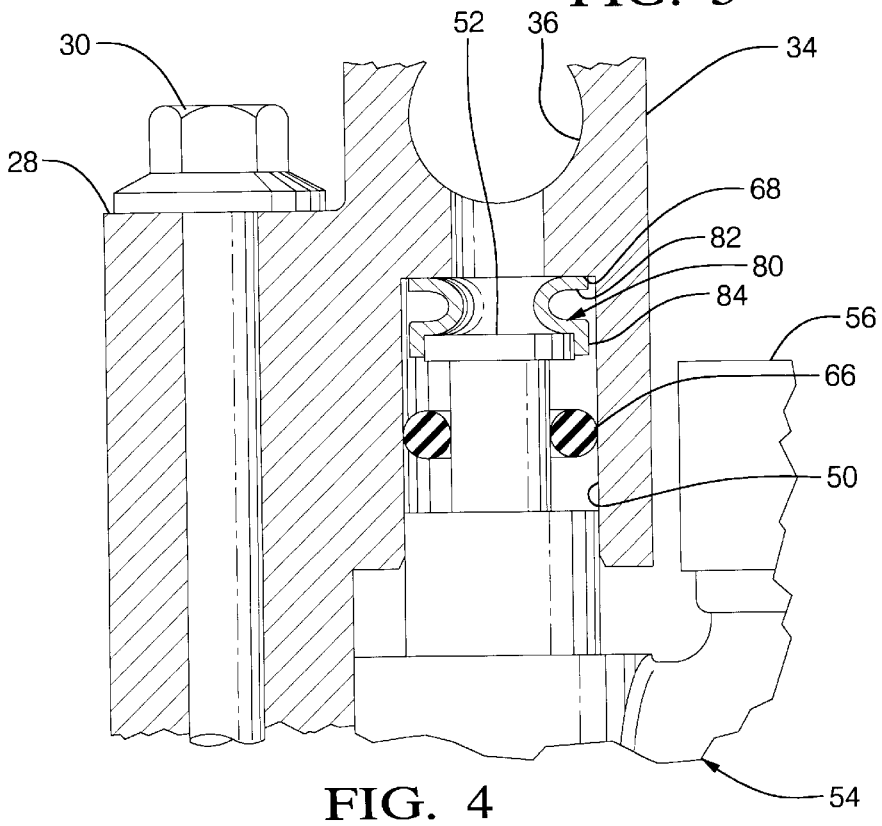
FIG. 4 is a cross-sectional view similar to FIG. 3 but showing an alternative embodiment of loading spring.

Referring now to FIG. 4, wherein like numerals indicate like parts, there is shown an alternative form of loading spring 80 which includes an annular generally C-shaped body 82 for directly engaging both the abutment 68 and the inlet end 52 of the injector. A depending flange 84 surrounds the inlet end of the injector for centering the spring properly thereon. In other details, the assembly is similar to that of FIGS. 1 and 3.

Figure 5:
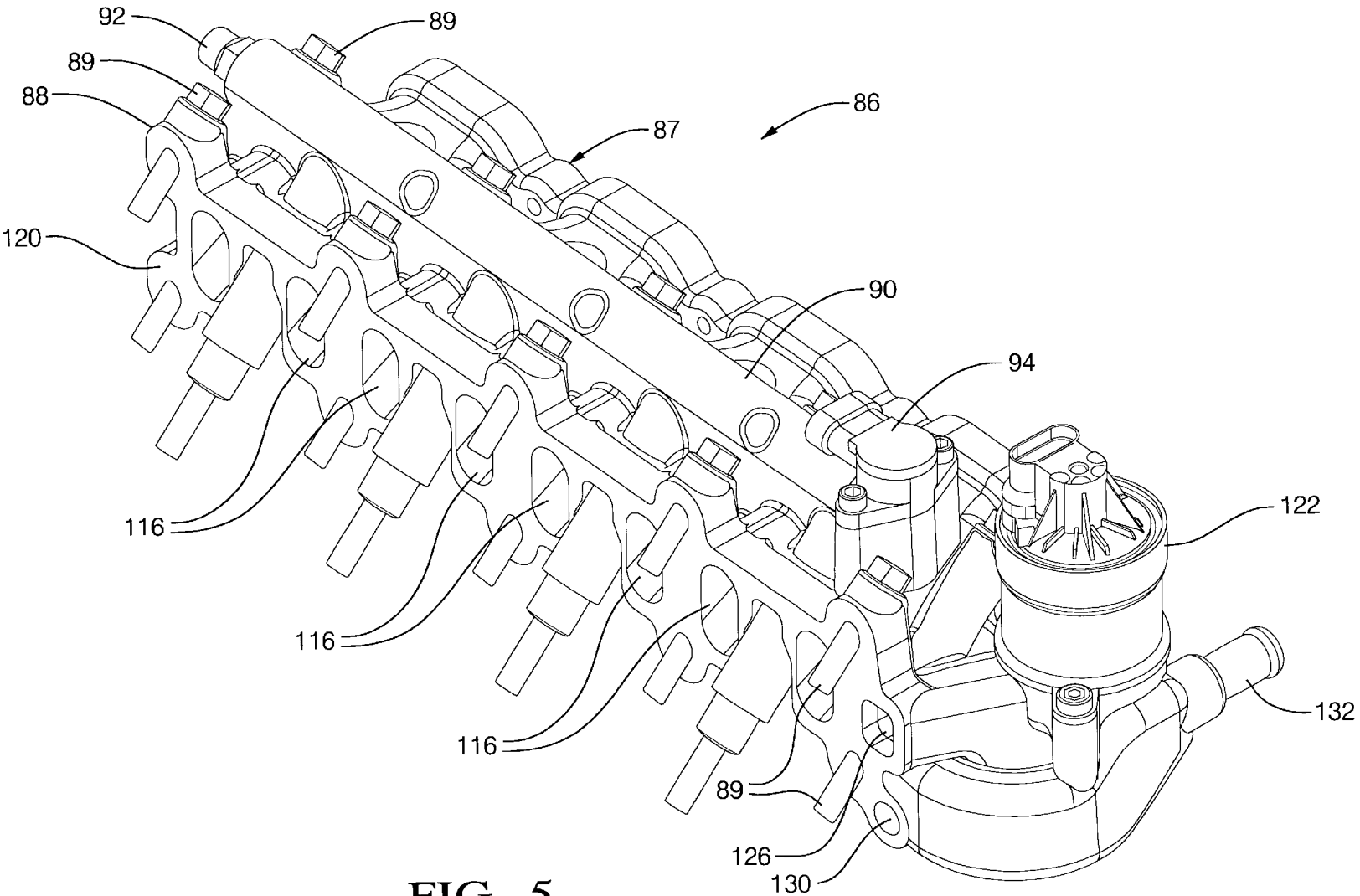
FIG. 5 is a pictorial view of an alternative embodiment of integrated fuel delivery module forming an extension of an air intake manifold.
Figure 6:
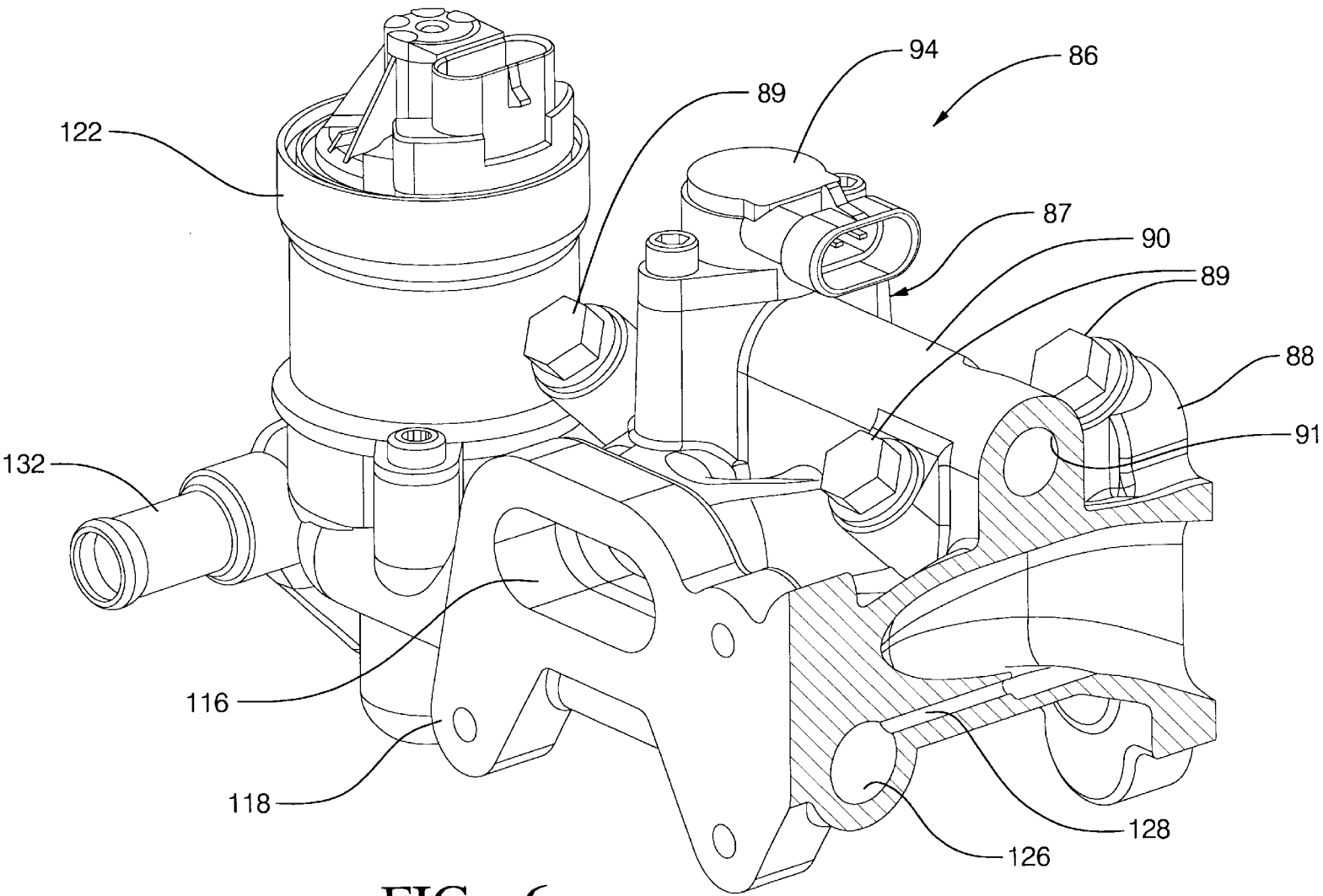
FIG. 6 is a pictorial view, partially in cross section, showing EGR passages in the module of FIG. 5.
Figure 7:
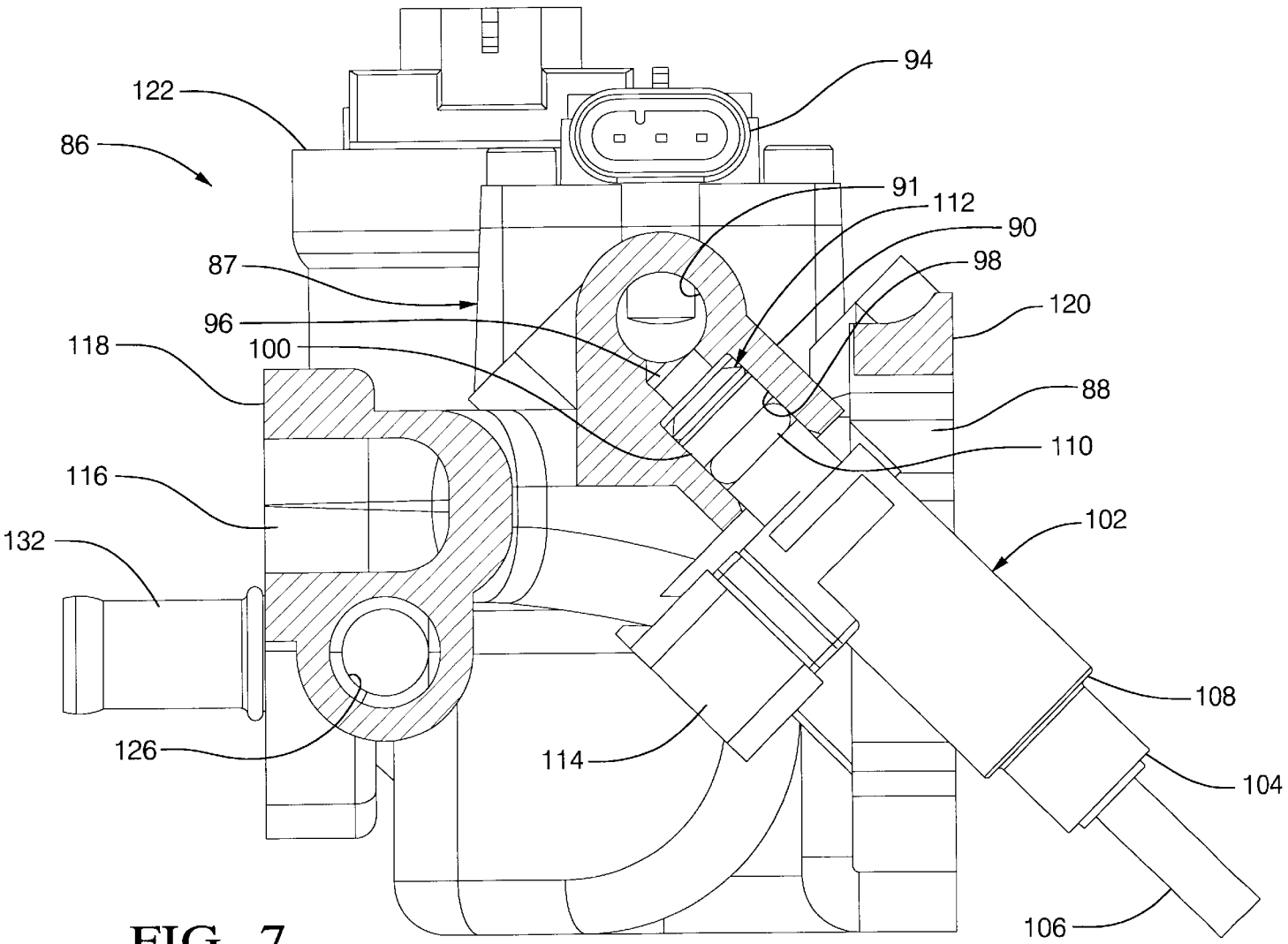
FIG. 7 is a cross-sectional view of a module similar to that of FIGS. 5 and 6 and showing the placement of one of the injectors therein.

Referring now to FIGS. 5–7 of the drawings, there is shown an alternative form of integrated fuel delivery module, generally indicated by numeral 86. Module 86 includes a body 87 with a mounting flange 88. Bolts 89 are provided for mounting the module on an associated engine cylinder head, not shown. As in the module embodiment previously described, the body 87 includes a fuel rail 90. Internally, the fuel rail defines a common fuel inlet passage 91 extending from an inlet fitting 92 at one end of the fuel rail to a fuel pressure regulator 94 mounted at the other end. A fuel return passage may also be provided, if desired. The common fuel inlet passage 90 connects at equally spaced intervals with feeder passages 96. Each of the passages 96 connects with a mounting recess 98 in which the inlet end 100 of a DI fuel injector 102 is received.

Injector 102 includes a compression seal surface 104 adjacent its nozzle end 106. An alternative seal surface 108, spaced further away from the nozzle end 106 may also be provided. As in the previous embodiment, injector 102 includes an O-ring seal 110 adjacent its inlet end, and has a loading spring assembly 112 engaging the inlet end of the injector and to be subsequently further described. As before, the injector is provided with an electrical connector 114 positioned for access from the exterior of the engine. The spring assembly 112 provides the necessary axial force on the injector to seat the injector fully in a respective recess, not shown, in the engine cylinder head and to prevent the injector from being moved by combustion chamber pressures existing in the engine cylinders.

In addition to the features described, which are similar to those of the previously described embodiment, module 86 additionally comprises an intermediate component mountable between the engine and an associated inlet manifold. The module 86 accordingly includes inlet air passages 116 which enter the body 87 through a surface 118 that is mountable to the inlet manifold. The air passages 116 then divide into separate legs, passing around the position of the associated fuel injector and through a surface 120 provided for mounting the module 86 to the cylinder head of the associated engine.

The integrated module 86 further includes an exhaust gas recirculation (EGR) valve 122 which connects with an internal EGR inlet passage 124 for providing exhaust gas to the valve 122. The valve controls EGR flow to a common EGR passage 126 which connects through metering orifices 128 with each, or every other, branch of the associated air intake passages 116. A coolant inlet passage 130 is also provided which conducts coolant around the base of the EGR valve to control its temperature and then directs it out through a tube fitting 132 for connection to another component or return to the cooling system.

Figure 8:
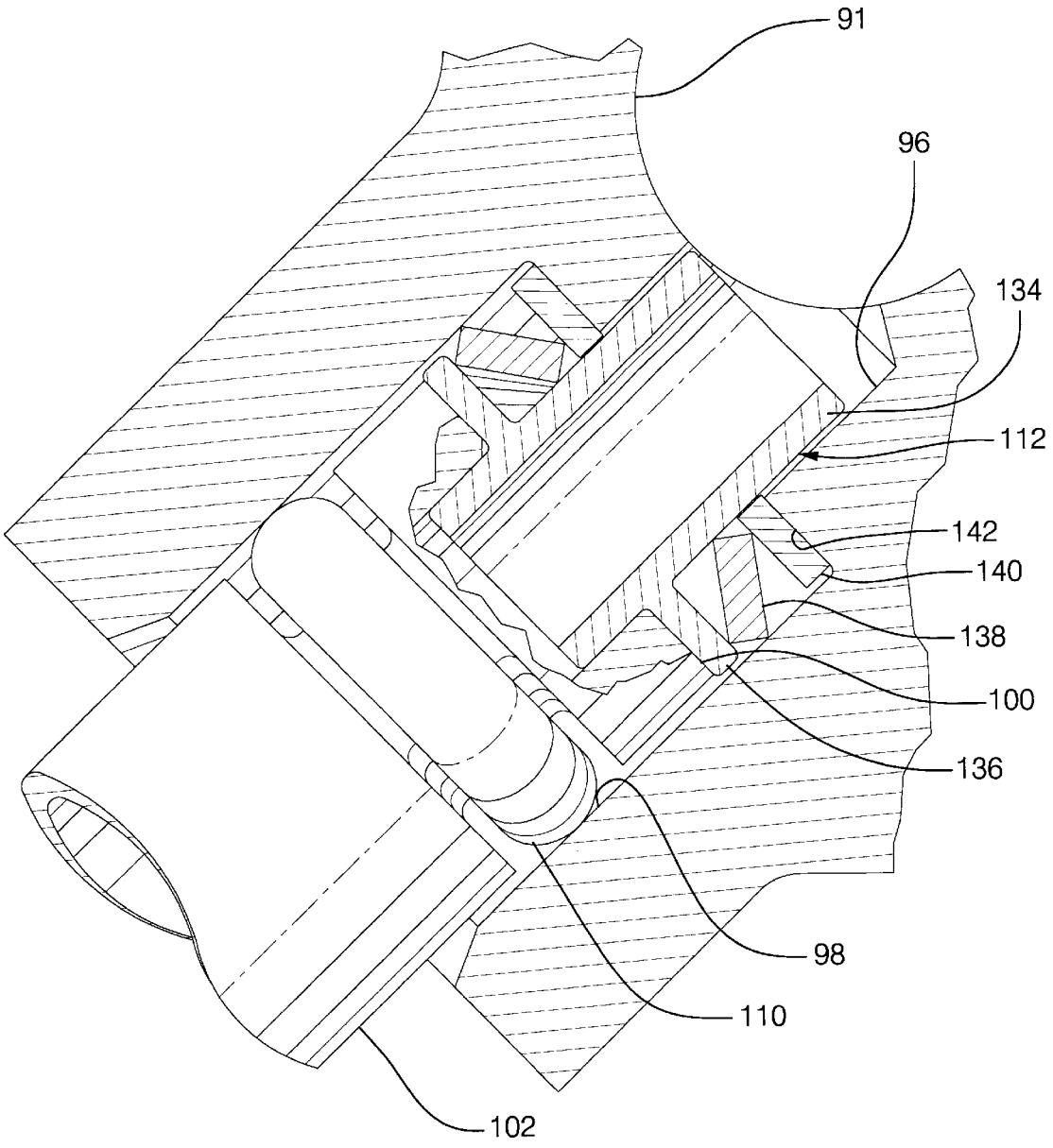
FIG. 8 is a cross-sectional view illustrating one embodiment of loading spring assembly for the injectors.
Figure 9:
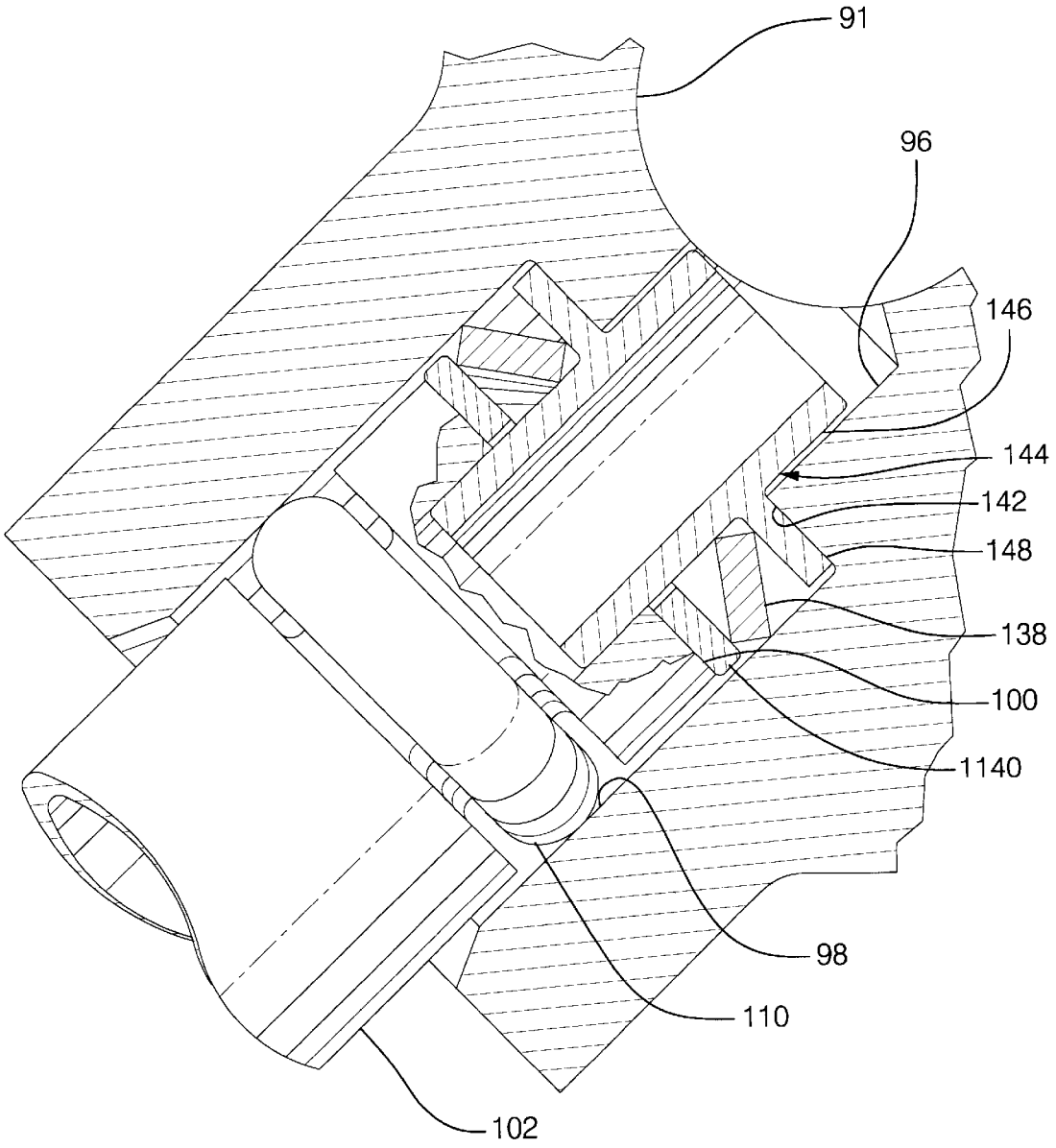
FIG. 9 is a view like FIG. 8 showing an alternative embodiment of injector loading spring assembly.
Figure 10:
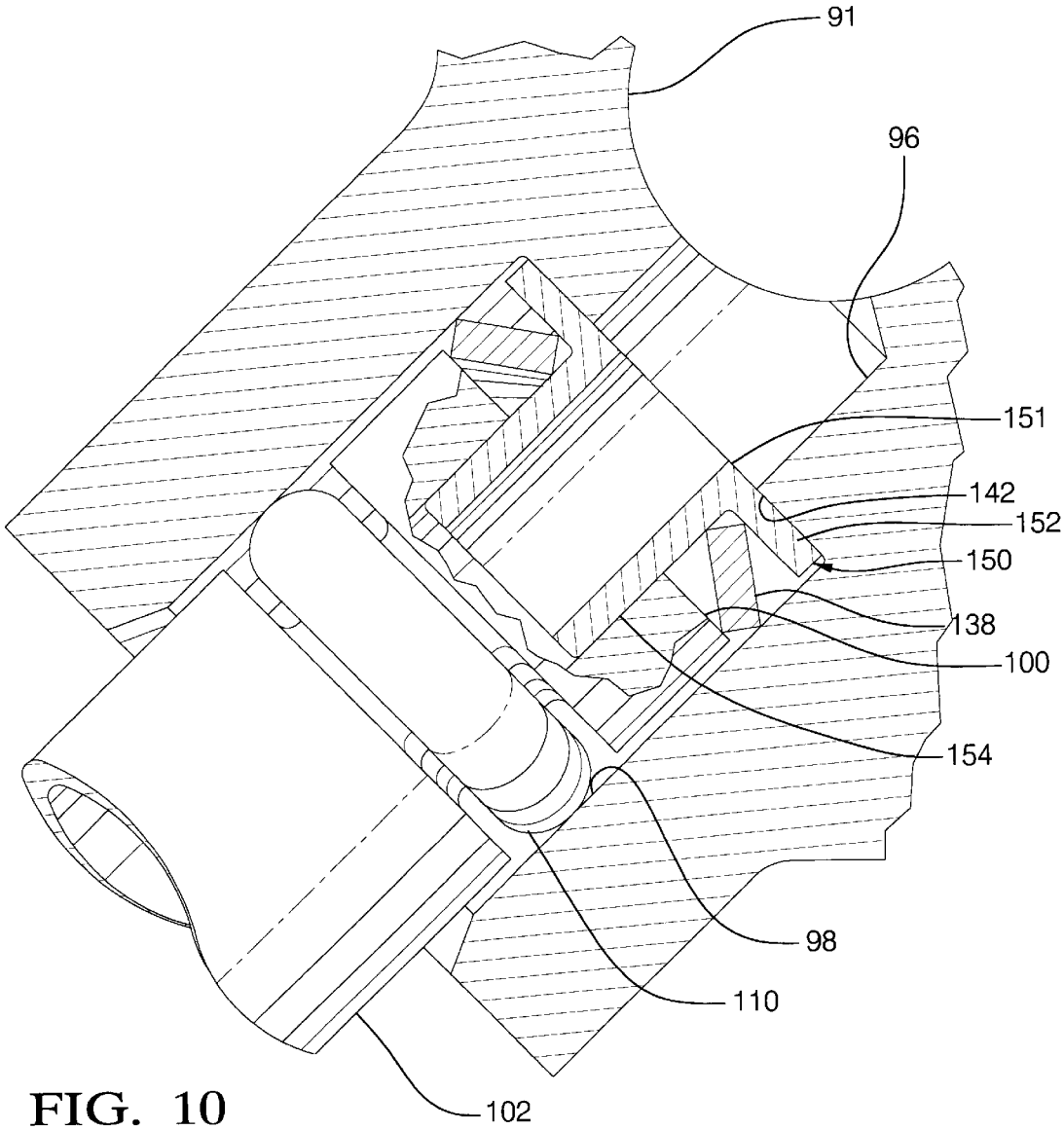
FIG. 10 is a view like FIGS. 8 and 9 showing still another embodiment of injector loading spring assembly.

FIGS. 8–10 disclose various embodiments of spring assemblies intended for use with module 86. Spring assembly 112, shown in FIG. 8, includes a tubular guide 134 that extends downward into the inlet bore of the associated injector 106 and upward into the associated feeder passage 96. Guide 134 includes a radially extending flange 136 which seats against the inlet end 100 of the injector and is engaged by a disk spring 138. A flat washer 140 is seated against an annular abutment 142 at the end of the mounting recess 98 to protect the abutment surface against wear. When the module 86 is installed, the disk spring 138 is partially compressed, loading the injector with a force sufficient to maintain seating of the injector against its seals and seal surfaces irrespective of cylinder pressures occurring in the engine combustion chamber.

FIG. 9 illustrates a slightly modified embodiment of spring assembly 144. Assembly 144 also includes a tubular guide 146 which extends downward into the inlet bore of the associated injector 106 and upward into the feed passage 96 of the associated fuel rail. In this version, the guide 146 has a radially extending annular flange 148 located so as to engage the associate abutment 142 of the mounting recess 98. A disk spring 138 engages the flange 148 and also bears against a flat washer 140 seated against the inlet end 100 of the injector.

Referring now to FIG. 10, a slightly different arrangement of spring 150 includes a guide 151 with a radially extending flange 152 connecting with a tubular portion 154 that extends only downward into the inlet bore of the associated injector 102. Flange 152 is engaged by a disk spring 138 which also directly engages the inlet end 100 of the associated injector. In all of these embodiments, an O-ring seal 110 is provided for sealing the connection against loss of fuel.

Figure 11:
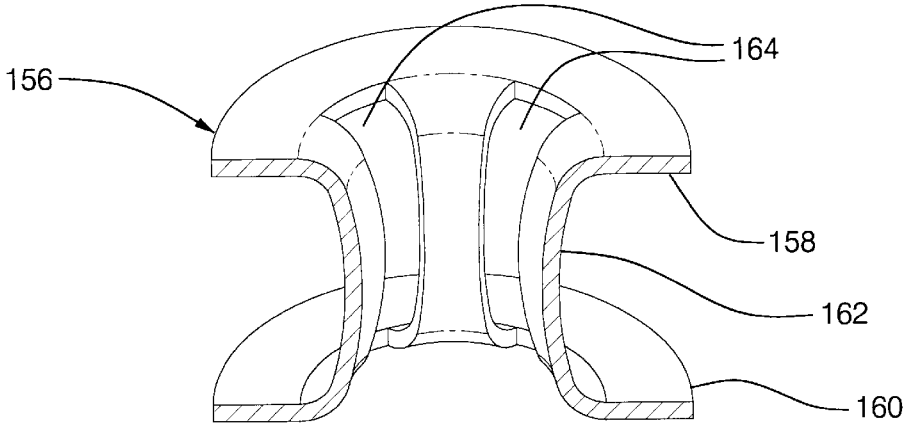
FIG. 11 is a pictorial view, partially in cross section, illustrating a different form of injector loading spring.

FIG. 11 illustrates still another embodiment, wherein a single configured spring is provided for engagement with both the abutment 142 and the inlet end 100 of the associated injector. Spring 156 is formed with a C-shaped cross section and outwardly extending end flanges 158, 160. A curved portion 162 interconnecting the flanges is broken by spaced openings 164 which allow the individual elements of the curved portion 162 to provide controlled flexing and loading within a required range required. Thus, the injector is seated with a load between a minimum value necessary to seal the injector/combustion chamber interface properly and a maximum value limiting loading of the injector body itself.

Thus the invention provides a fuel delivery module which integrates a fuel rail with its associated connections, features and components, with the injectors for one bank of a direct injection engine. When the module is secured to the engine, loading springs between the inlet ends of the injectors and abutments in the mounting recesses accommodate variations in manufacturing and assembly tolerances to provide adequate but not excessive loading of the injectors against associated seal surfaces. Manufacturing and assembly costs are reduced by the use a module with injectors pre-installed. Also, the assembly may be pretested in a suitable test fixture prior to installation to assure proper flow and spray development from each of the injectors. As noted, the module may integrate other components also, such as intake air passages, EGR passages and coolant passages and their associated components.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A module for the direct injection of fuel into the combustion chambers of multiple cylinders of an internal combustion engine, said module comprising:

a body including means for mounting the body on a combustion chamber defining member of the engine;

a fuel rail having a common fuel inlet passage extending longitudinally in the body and a plurality of longitudinally spaced laterally extending fuel feeder passages communicating with said inlet passage;

an open ended mounting recess extending from each feeder passage, each recess defining an annular abutment adjacent its feeder passage;

a direct acting fuel injector having an inlet end sealingly received in each recess and spaced from said abutment; and a loading spring disposed in each mounting recess and compressible between its respective abutment and the associated injector inlet end for loading the injector against a seat of the combustion chamber defining member for holding the injector on the seat against the force of combustion pressures acting on the injector from the combustion chamber during engine operation.

2. A module as in claim 1 wherein said spring acts directly between said abutment and the associated injector inlet end.

3. A module as in claim 1 wherein said spring seats against at least one washer.

4. A module as in claim 3 wherein said washer includes guide means for radially locating the spring relative to the injector.

5. A module as in claim 4 wherein said guide means has a tubular portion extending into an inlet opening of the associated injector.

6. A module as in claim 1 wherein said spring seats against two washers.

7. A module as in claim 1 wherein said spring is a conical disk spring.

8. A module as in claim 1 wherein said spring has a C-shaped cross section.

9. A module as in claim 8 wherein said spring includes a guide for centering the spring relative to the injector.

10. A module as in claim 8 wherein said spring is symmetrical to prevent improper installation.

11. A module as in claim 1 and mounting a fuel pressure sensor in communication with said common fuel inlet passage.

12. A module as in claim 11 and including a fuel pressure regulator and a fuel return fitting, both in communication with said common fuel inlet passage.

13. A module as in claim 1 and defining at least a portion of an air intake manifold.

14. A module as in claim 1 and including air passages for the delivery of air from an associated air intake manifold to said combustion chamber defining member.

15. A module as in claim 14 and mounting an EGR valve, said module having passages for conducting engine exhaust gas through the EGR valve to said air passages.

16. A module as in claim 15 and including coolant passages for conducting engine coolant adjacent the EGR valve for cooling the valve during engine operation.

* * * * *